United States Patent [19]

Ishii et al.

[11] Patent Number: 4,742,212

[45] Date of Patent: May 3, 1988

[54] FLEXIBLE HEATING WIRE

[75] Inventors: Kazunori Ishii, Nara; Yoshio Kishimoto, Osaka; Shuji Yamamoto, Nara, all of Japan

[73] Assignee: Matsushita Electric Industrial Co., Ltd., Japan

[21] Appl. No.: 797,155

[22] Filed: Nov. 12, 1985

Related U.S. Application Data

[62] Division of Ser. No. 609,216, May 11, 1984, Pat. No. 4,575,620.

[30] Foreign Application Priority Data

| | | | |
|---|---|---|---|
| May 11, 1983 | [JP] | Japan | 58-80771 |
| May 18, 1983 | [JP] | Japan | 58-86927 |
| May 18, 1983 | [JP] | Japan | 58-86928 |
| Oct. 20, 1983 | [JP] | Japan | 58-196312 |
| Oct. 20, 1983 | [JP] | Japan | 58-196314 |

[51] Int. Cl.[4] ..... H05B 3/34

[52] U.S. Cl. ..... 219/549; 174/107; 219/553

[58] Field of Search ..... 219/549, 211, 212, 345, 219/494, 504, 505, 528, 529, 553; 338/22 SD, 210, 223, 224, 308, 314; 252/511; 174/106 SC, 107, 120 SC

[56] References Cited

U.S. PATENT DOCUMENTS

| | | | |
|---|---|---|---|
| 2,820,085 | 1/1958 | Crowley | 174/107 |
| 4,271,350 | 6/1981 | Crowley | 219/549 |
| 4,503,322 | 3/1985 | Kishimoto et al. | 219/505 |

FOREIGN PATENT DOCUMENTS

| | | |
|---|---|---|
| 1193593 | 11/1959 | France . |
| 1522664 | 4/1968 | France . |
| 1168162 | 10/1969 | United Kingdom . |
| 2079569 | 1/1982 | United Kingdom . |

*Primary Examiner*—Clifford C. Shaw
*Assistant Examiner*—M. M. Lateef
*Attorney, Agent, or Firm*—Lowe, Price, LeBlanc, Becker & Shur

[57] ABSTRACT

A flexible heating wire includes a first conductive body, and a second conductive body, a thermally fusible electrically insulative body arranged such that the first and second conductive bodies will be brought into electric contact with each other when the thermally fusible electrically insulative body is thermally fused. Further provided is a third conductive body and a heating body having a positive temperature coefficient and held in electric contact with at least one of the first and second conductive bodies and the third conductive body. The flexible heating wire is capable of self-controlling the temperature of the heated heating body. The flexible heating wire can detect the danger of localized overheating, abnormal overheating, or the generation of an arc which is caused when the heating wire is subjected to external oppression, bending, or twisting, or when the heating wire is heated by an external source, or when a conductive material has been mixed in the PTC heating body. Through such detection, the flexible heating wire is prevented from being overheated beyond a certain temperature setting. The flexible heating wire will not be heated up to a high temperature after use over a prolonged period of time.

7 Claims, 9 Drawing Sheets

FLEXIBLE HEATING WIRE

This is a division of application Ser. No. 609,216, filed May 11, 1984, now abandoned.

BACKGROUND OF THE INVENTION

The present invention relates to a flexible heating wire for use in heaters.

Various flexible heating wires composed of heating bodies having a positive temperature coefficient have been known in the art. However, the known flexible heating wires have proven unsatisfactory in that they are relatively poor in safety and reliability.

SUMMARY OF THE INVENTION

It is an object of the present invention to provide a flexible heating wire which is safe and reliable to eliminate the conventional drawbacks.

To achieve the above object, a flexbile heating wire according to the present invention includes a first conductive body, a second conductive body, a thermally fusible electrically insulative body which are arranged such that the first and second conductive bodies will be brought into electric contact with each other when the thermally fusible electrically insulative body is thermally fused, a third conductive body disposed in spaced relation to the first and second conductive bodies and the thermally fusible electrically insulative body, and a heating body having a positive temperature coefficient and held in electric contact with at least one of the first and second conductive bodies and the third conductive body.

BRIEF DESCRIPTION OF THE DRAWINGS

The present invention will be described in detail by way of illustrative example with reference to the accompanying drawings, in which.

DETAILED DESCRIPTION

Figure 1:
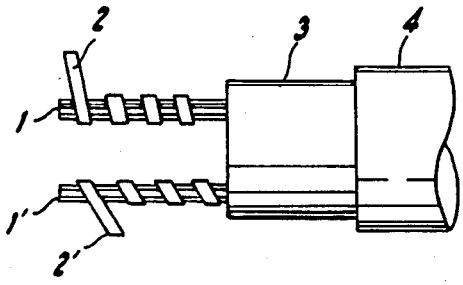
FIG. 1 PRIOR ART
FIGS. 1 and 2 are front elevational views of conventional flexible heating wires.

One of conventional heating bodies having a positive temperature coefficient (hereinafter referred to as a "PTC heating body") is illustrated in FIG. 1 of the accompanying drawings. The PTC heating body, designated at 3 in FIG. 1, has a pair of parallel conductive members or wires 2, 2' disposed therein and helically wound around a pair of cores 1, 1', respectively. The PTC heating body 3 is surrounded by an insulative tube 4. With the PTC heating body 3 of the above arrangement, a certain self-controlled temperature can be established according to a PTC curve of the PTC heating body 3. Where the distance between the conductive wires 2, 2' is locally reduced due to external oppression, bending, or twisting, or a conductive material has erroneously been mixed into a localized portion the PTC heating body 3, however, the resistance of the entire PTC heating body remains substantially unchanged. The localized portion suffering from such difficulties tends to be overheated, subjected to the generation of an arc, and short-circuiting between the conductive wires 2, 2', resulting in the danger of burns or fires.

Figure 2:
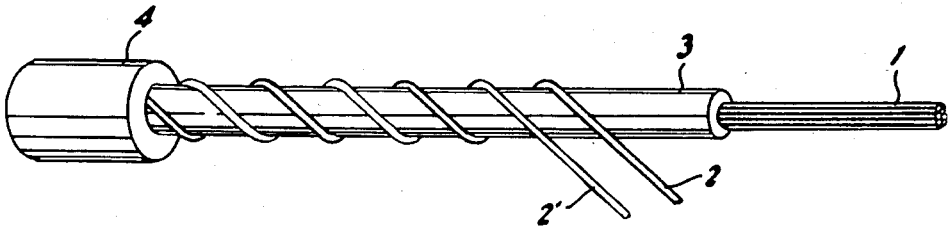
FIG. 2 PRIOR ART

FIG. 2 shows another conventional arrangement in which a pair of conductive wires 2, 2' are helically wound around a PTC heating body 3 and tubed by an insulative tube 4. The PTC heating body 3 has a core 1 disposed therein. The prior PTC heating body 3 shown in FIG. 2 can establish a certain self-controlled temperature according to its PTC curve. However, it has also suffered from the same disadvantages as described above with respect to the PTC heating body 3 illustrated in FIG. 1.

When there is a short circuit between the conductive wires 2, 2' in the illustrated prior constructions, the current flowing through the conductive wires could be cut off simply by a current fuse, for example, since the current varies to a large extent upon short-circuiting. However, the resistance of the PTC heating body 3 tends to remain substantially the same for the reasons described above, or varies within a self-controlled temperature range thereof. When a current flows through any defective localized portion of the PTC heating body 3, no desired safety can be maintained.

The present invention will now be described.

Figure 3A:
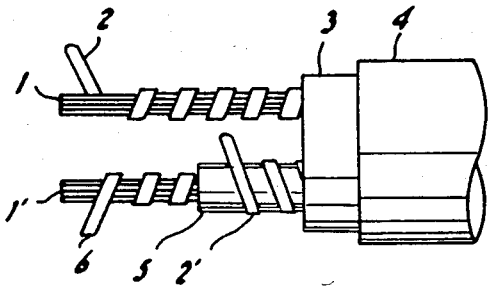
FIGS. 3(*a*) and 3(*b*) are front elevational and end views of a flexible heating wire according to a first embodiment of the present invention.
Figure 3B:
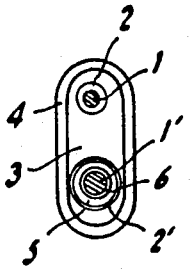

FIGS. 3(*a*) and 3(*b*) show a flexible heating wire according to a first embodiment of the present invention. A first conductive body or wire 6 and a third conductive body or wire 2 are helically wound around a pair of cores 1', 1, respectively. The first conductive wire 6 is covered with a thermally fusible insulative body or layer 5 made of nylon 12 on which a second conductive body or wire 2' is helically wound. The second and third conductive wires 2', 2 are covered with a PTC heating body 3 in electric contact therewith, the PTC heating body 3 being covered with an outer insulative sheath 4.

Figure 4A:
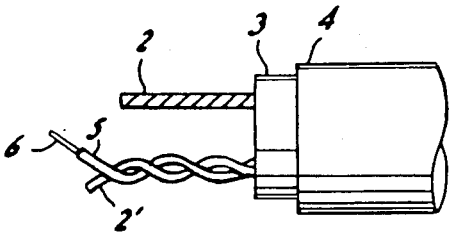
FIGS. 4(*a*) and 4(*b*) are front elevational and end views of a flexible heating wire according to a second embodiment of the present invention.
Figure 4B:
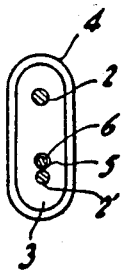

FIGS. 4(*a*) and 4(*b*) illustrate a flexible heating wire according to a second embodiment. A first conductive wire 6 is covered with a thermally fusible insulative body 5. The covered first conductive wire 6 and a second conductive wire 2' are twisted around each other. The first and second conductive wires 6, 2' as twisted and a third conductive wire 2 extending parallel thereto in spaced relation are covered with a PTC heating body 3 which is covered with an outer insulative sheath 4.

In each of the above embodiments, the PTC heating body 3 is heated by the second and third conductive wires 2', 2 serving as electrodes up to a certain self-controlled temperature according to its PTC curve. When the PTC heating body 3 is unduly overheated, the thermally fusible insulative body 5 is fused or melted away to cause a short circuit between the second and first conductive wires 2', 6, thus detecting an abnormal temperature rise. At the same time, the current flowing through the conductive wires is cut off by melting a fuse (not shown).

The above arrangement can maintain a sufficient degress of safety against localized undue overheating. More specifically, when the distances between the conductive wires 2, 2', 6 are locally reduced due to external oppression, bending, or twisting, or when a conductive material has been mixed in the PTC heating body 3, or when the electrode wires are cut off or about to be cut off, or when the flexible heating wire is heated by an external source, the thermally fusible electrically insulative body or layer 5 is fused to allow the second and first conductive wires 2', 6 to be brought into electric contact with each other, thus melting a fuse or the like to cut off the current to thereby prevent abnormal overheating or localized overheating.

Another thermally fusible insulative body and a first conductive wire may also be provided in combination with the third conductive wire 2 for better detection and prevention of abnormal or localized overheating. The first and second conductive wires 6, 2' may be short-circuited in the longitudinal direction of the core 1' providing they can be electrically connected through the melting of the thermally fusible electrically insulative body 5. The first through third conductive wires 6, 2', 2 may not be wound around the cores, but may be arranged otherwise.

A flexible heating wire according to a third embodiment of the present invention will be described with reference to FIG. 5.

A pair of second and third parallel conductive wires 2', 2 is helically wound around a PTC heating body 3 surrounding a core 1. A thermally fusible electrically insulative body 5 is disposed around and in contact with the PTC heating body 3 and the second and third conductive wires 2', 2. A first helical conductive wire 6 is disposed around the thermally fusible electrically insulative body 5, and covered with a tubular insulative sheath 4.

Figure 5:
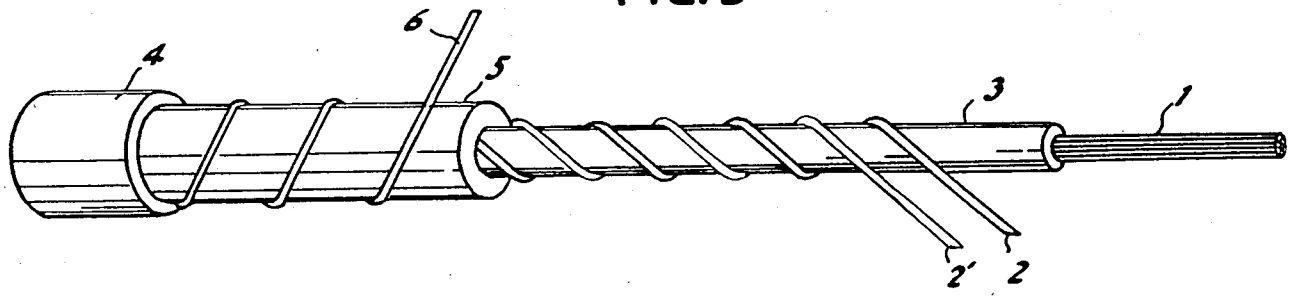
FIG. 5 is a perspective view of a flexible heating wire according to a third embodiment of the present invention.

The arrangment shown in FIG. 5 can also have sufficient safety against abnormal localized overheating. In use, the PTC heating body 3 is heated to a certain self-controlled temperature by the second and third conductive wires 2', 2. When the distances between the electrode wires are locally reduced due to external oppression, bending, or twisting, or when a conductive material has been mixed in the PTC heating body 3, or when the second and third electrode wires 2', 2 are cut off or about to be cut off, or when the flexible heating wire is heated by an external source, the thermally fusible electrically insulative body 5 is fused by the overheating due to an arc generated to allow the second and first conductive wires 2', 2 to be brought into electric contact with the first conductive wire 6, which then passes a current melting a fuse or the like to cut off the current to thereby prevent abnormal overheating or localized overheating. Since the second and third conductive wires 2', 2 are disposed between the thermally fusible electrically insulative body 5 and the PTC heating body 3 in intimately contacting relation, the second and third conductive wires 2', 2 serving as electrodes are subjected to only small displacements under any conditions, and hence the PTC heating body 3 can be heated uniformly.

Figure 6:
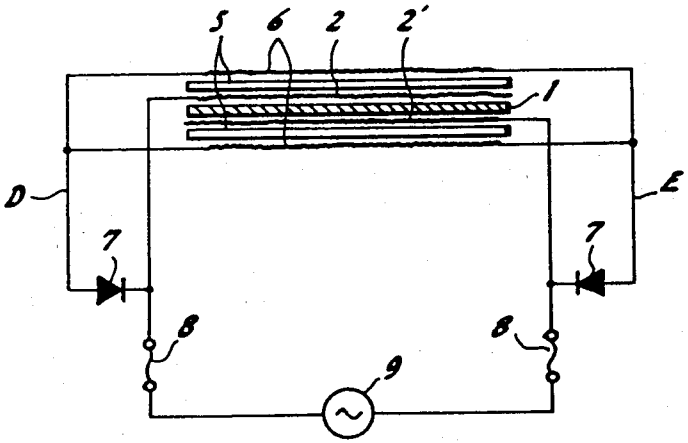
FIG. 6 is a circuit diagram of a circuit arrangement including the flexbile heating wire according to the third embodiment.

FIG. 6 illustrates a circuit arrangement of a heater such as an electrically heatable blanket or an electrically heatable carpet in which the flexible heating wire shown in FIG. 5 is incorporated. As shown in FIG. 6, a safety circuit is composed of diodes 7 and fuses 8 connected to an AC power suply 9.

Operation of the arrangement of FIGS. 5 and 6 will now be described. When the flexible heating wire is subjected to undue overheating or localized overheating due to various abnormal conditions, the thermally fusible electrically insulative body 5 is melted away and the diameter of the helical coils of the conductive wires 2, 2' is increased due to their tensile strength until the condictive wires 2, 2' are brought into mechanical contact with the first conductive wire 6. Upon contact between the first conductive wire 6 and any one of the second and third conductive wires 2', 2, one of the fuses 8 is melted away to cut off the current. The first conductive wire 6 may be disposed radially inwardly of the PTC heating body 3. With such an alternative, the first conductive wire 6 will be brought into mechanical contact with the second and third conductive wires 2', 2 due to the tensile strength of the wire 6, and hence the same degree of safety can be achieved.

The fuses 8 will be cut off by being heated by a high current flowing therethrough. However, a resistor capable of producing an amount of heat at a level ranging from 10 to 40 W may electrically be connected between points, D, E in the circuit of FIG. 6, and the fuses 8 may comprise temperature fuses that can be melted at a temperature ranging from about 90° to 150° C., so that the fuses 8 are thermally coupled.

Figure 7:
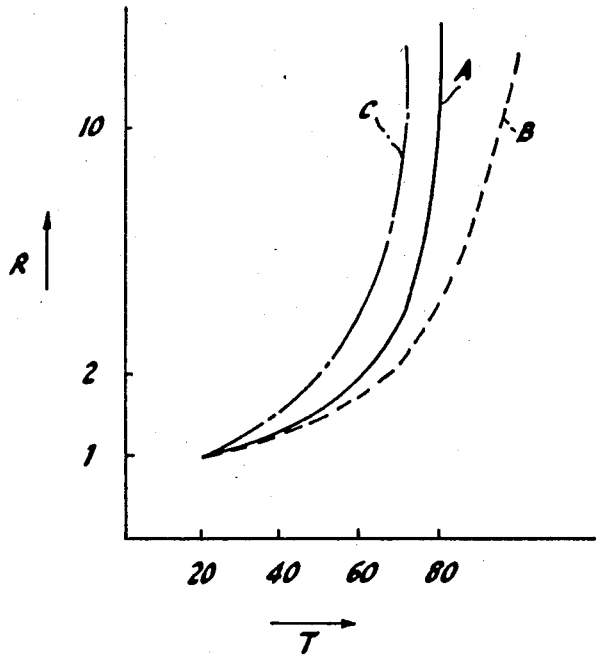
FIG. 7 is a graph showing characteristics of the heating body of the invention.

FIG. 7 is illustrative of resistance-vs-temperature curves of the PTC heating body 3 according to the above embodiments. The graph of FIG. 7 has a horizontal axis indicative of a temperature T (°C.) and a vertical axis representative of a resistance R (kΩ) per meter of the PTC heating body. At an initial stage of use, the PTC heating body has a characteristic curve A. With the flexible heating wire having a possible maximum thermal insulation, its temperature will not rise beyond a maximum self-heated temperature of about 80° C.

In general, the PTC heating body has a tendency to have a characteristic curve B after use over a long period of time. The maximum self-heated temperature is increased with time, a feature which makes the flexible heating body dangerous is use. However, since the current flowing through the conductive wires can completely be cut off when a temperature at which the thermally fusible electrically insulative body 5 is fusible is reached, and therefore the flexible heating body is quite safe in use. The temperature at which the thermally fusible electrically insulative body 5 can be fused is selected to be a temperature or below which can be regarded as safe when the flexible heating wire is heated to various abnormal temperatures higher than the maximum self-heated temperature. Such fusible temperature is in the range of from 90° C. to 200° C. dependent on the heater in which the flexible heating wire is in corporated. Accordingly, the thermally fusible electrically insulative body 5 is made of a thermoplastic crystalline polymer having a melting point in the range of from 90° C. to 200° C., such as polyester, polyolefin, polyamide, polyurethane, or the like. Nylon 11, nylon 12 which are polyamides, a modification or copolymer thereof, is most preferable as it has a melting point in the range of from 150° C. to 200° C. and a low melting viscosity.

The flexible heating wire shown in FIGS. 3(*a*) and 3(*b*) includes the cores 1, 1', and has an increased tensile strength and high bending strengths.

The PTC heating body 3 and the thermally fusible electrically insulative body 5 are compatible with each other so that the material of the thermally fusible electrically insulative body 5 will blend into the PTC heating body 3 until finally the PTC heating body 3 will have a characteristic curve C in FIG. 7. Since the PTC heating body 3 will finally reach a state in which it will not be heated, the flexible heating wire has a high degree of safety. The rate at which the thermally fusible electrically insulative body 5 blends into the PTC heating body 3 should be selected dependent on the rate at which the characteristic curve of the PTC heating body 3 is shifted toward the curve B and the service life which the flexible heating wire should have. A suitable material for meeting such conditions should be selected of the thermally fusible electrically insulative body.

The PTC heating body 3 comprises a polymer compound containing a particulate conductive material such as carbon black. Resins for use as such a polymer compound include polyolefins such as a polyethylene-vinyl acetate copolymer, a polyethylene-ethyl acrylate copolymer, polyethylene, polypropylene, and the like, and crystalline resins such as polyamide, polyhalogenated vinylidene, polyester, and the like, these resins having a sharp positive temperature coefficient in the vicinity of the grain transformation point.

The second and third conductive wires 2', 2 shown in FIG. 5 are spaced from each other a distance in the range of from 0.3 to 2 mm. The PTC heating body 3 may be of a compound having a high specific resistance to achieve PTC characteristics for self temperature control with ease.

Figure 8:
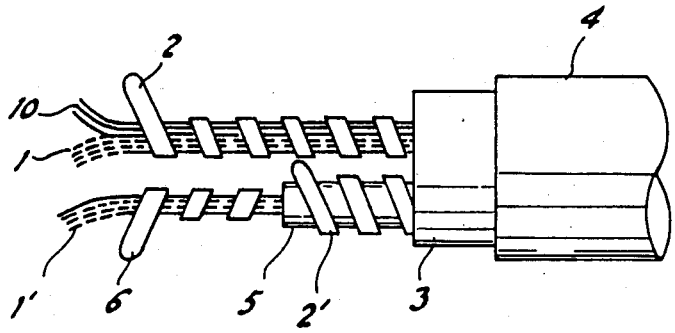
FIG. 8 is a front elevational view of a flexible heating wire according to a fourth embodiment of the present invention.

FIG. 8 illustrates a flexible heating wire according to a fourth embodiment which is similar to the arrangement of FIG. 3 and in which second and third conductive wires 2', 2 in particular are arranged to be subjected to a reduced voltage drop and to provide an increased bending strength. The flexible heating wire of FIG. 8 is particular suitable for use with a high-capacity electric device. In FIG. 8, the third conductive wire 2 is helically wound around a composite core composed of a core 1 and an electrically conductive wire 10, the third conductive wire 2 and the electrically conductive wire 10 jointly serving as a first electrode wire. The third conductive wire 2 and the electrically conductive wire 10 are kept at the same electric potential anywhere in their longitudinal direction, they may be spaced from each other or held in contact with each other in certain positions. The core 1 and the conductive wire 10 may be in the form of parallel or twisted strands with the third conductive wire 2 helically wound therearound. The core 1 should preferably comprise fibers having a coefficient of thermal expansion. Where the electrically conductive wire 10 is made of copper or the like, the core 1 should preferably be composed of fibers of small thermal expansion and contraction. Glass fibers or fibers of aromatic polyamide are suitable among others. The core fibers should be of a fineness of 3000 denier or smaller, that is, a diameter of 0.6 mm or smaller and should be mechanically strong for best resutls, the aromatic polyamide fibers being the best choice from this standpoint.

Figure 9A:
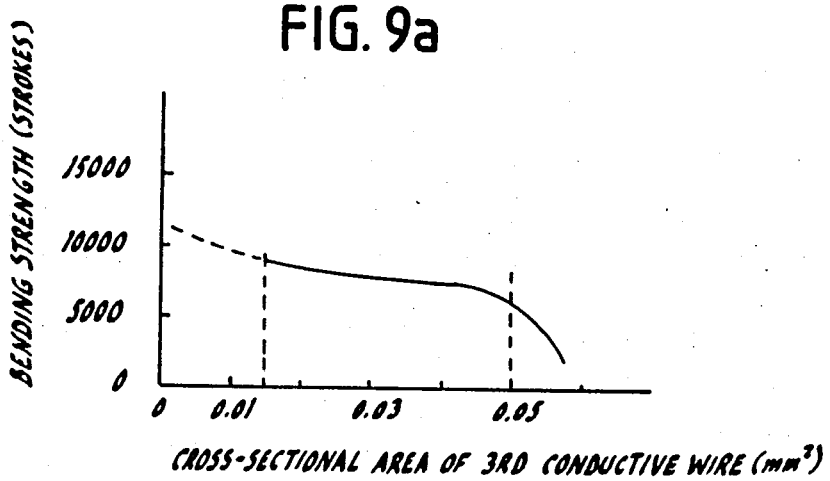
FIGS. 9(*a*) and 9(*b*) are graphs showing characteristics of the flexible heating wire of FIG. 8.
Figure 9B:
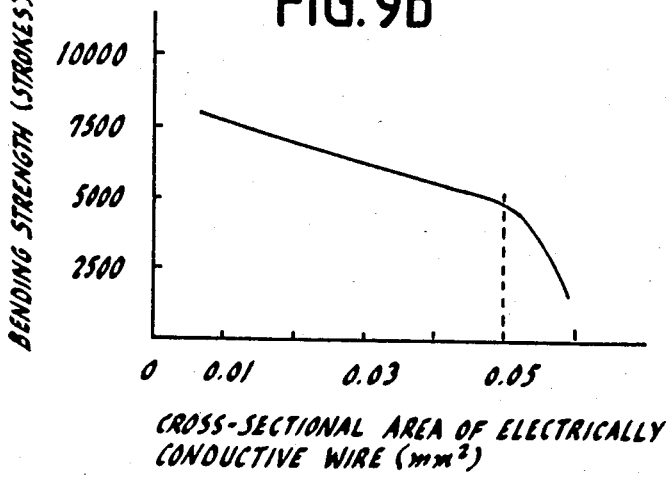

The third conductive wire 2 should be made of copper or an alloy of copper having a high conductivity. Where the core core fibers comprise 2000-denier fibers, the flexible heating wire of FIG. 8 has a high bending strength when the cross-sectional area of the third conductive wire 2 is in the range of from 0.015 to 0.05 $mm^2$, as shown in FIG. 9(*a*), and when the cross-sectional area of the electrically conductive wire 10 is 0.05 $mm^2$ or smaller.

As illustrated in FIG. 8, a first conductive wire 6 is helically wound around a core 1' and covered with a thermally fusible electrically insulative body 5 around which a second conductive wire 2' is helically wound. The second conductive wire 2' is covered with a PTC heating body 3 enclosed in an outer insulative sheath 4. The second electrode wire 2' is of a diameter of 0.8 mm and its bending strength is out of the question and thus too poor. To heat the high-capacity heater, it is necessary to pass a large current through the flexible heating wire. If the electrode wire 2 had a high resistance, it would dissipate a large amount of heat and the voltage applied across the PTC heating body 3 would be reduced, resulting in poor PTC charactersitics thereof. Accordingly, the electrode wires should be of a low resistance. A required bending strength can then be achieved by winding the electrode wires around cores of fibers having a fineness of 3000 denier or smaller (or a diameter of 0.6 mm or smaller).

Figure 10:
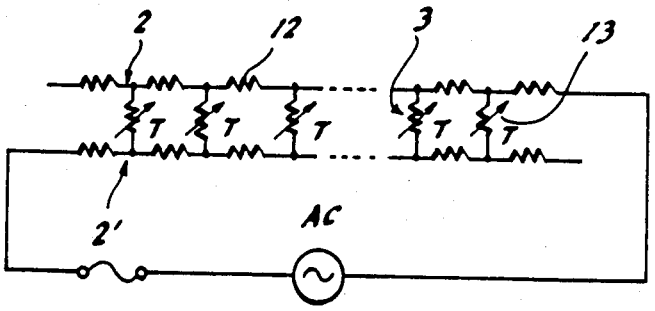
FIG. 10 is a circuit digram of an equivalent circuit arrangement of the flexible heating wire of FIG. 8.

However, the electrode wires 2, 2' may be of a resistance capable of generating a certain amount of heat and an equivalent circuit as shown in FIG. 10 may be employed to limit a large rush current during an initial stage of energization of the flexible heating wire. The electrode wires have resistances 12 and the PTC heating body 3 has variable PTC resistances 13 which vary with temperature T.

A specific example of the flexible heating wire shown in FIG. 8 will be described. 1500-denier fibers of aromatic polyamide as the core 1 and four copper-silver wires each of a diameter of 0.15 mm as the electrically conductive wires 10 were twisted together, and a copper-silver wire having a diameter of 0.23 mm as the third conductive wire 2 was formed into a foil having a thickness of 0.08 mm, which was then helically wound around the twisted core 1 and wires 10 to provide a first electrode. The first electrode had a resistance per meter of 0.22 Ω/m. A first conductive copper-silver wire 6 was helically wound around a core 1' of 2000-denier fibers of aromatic polyamide, and was covered with a thermally fusible electrically insulative body 5 of polyamide around which a second conductive copper-silver wire 2' was helically wound, thus providing a second electrode. The second electrode had a resistance per meter of 0.22 Ω/m. The first and second electrodes were fed parallel to each other into a wire extruder in which they were encased in a PTC heating body 3 composed mainly of a copolymer of polyethylene and vinyl acetate containing carbon black. After the PTC heating body 3 was subjected to cross-linking with an electron beam, it was covered with an outer insulative sheath 4. The PTC heating body 3 had a resistance of 300Ω per meter between the first and second electrodes at normal temperature. The resultant flexible heating wire was cut to two lengths each 40 m long, which were placed respectively in two halves of a carpet each having an area of about 3.3 $m^2$. When an AC voltage of 100 V was applied to the carpet through the circuit as illustrated in FIG. 10, the electrically heatable carpet was heated with the PTC heating body having a maximum temperature of 75° C. without any localized overheating. The carpet was subjected to a bending test in which the carpet was bent reciprocally through 90°, and exhibited an excellent bending strength enduring 23000 bending strokes.

The first conductive wire 6 shown in FIG. 8 serves as a signal wire having a cross-sectional area on the order of 0.03 $mm^2$ which allows a sufficient high degree of bending strength without any problems.

An arrangement in which one of conductive wires comprises a heating wire. Where an electric device using a flexible heating wire of the invention is of a high capacity and the resistance of the PTC heating body has a high rate of change, an overcurrent higher than an allowable level for domestic power outlets tends to flow at the time the electric device starts to be energized. Although this problem can be coped with by adjusting the electrode resistances, another solution is to use one of three conductive wires 2, 2', 6 as a heating body.

Figure 11:
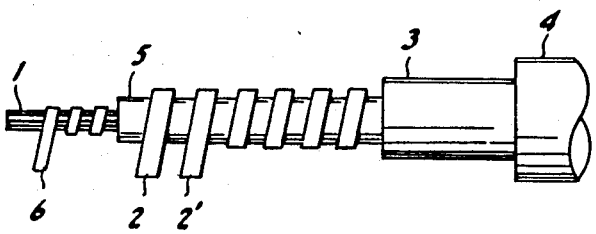
FIG. 11 is a front elevational view of a flexible heating wire according to a fifth embodiment of the present invention.

One such arrangement is illustrated in FIG. 5 which shows a flexible heating wire according to a fifth embodiment of the present invention. In FIG. 11, a first conductive wire 6 serving as a heating body is helically wound around a core 1 and covered with a cylindrical thermally fusible electrically insulative body 5, around which a pair of second and third conductive wires 2', 2 is helically wound in spaced relation to each other. The second and third conductive wires 2', 2 are covered with a PTC heating body 3 and an outer insulative sheath 4. The components of the flexible heating wire shown in FIG. 11 may be of the materials referred to above. With the two heating bodies of different characteristics being incorporated in the flexible heating wire, the flexible heating wire can be controlled relatively easily to the advantage of the heating bodies for increased safety and ease of use.

Figure 12:
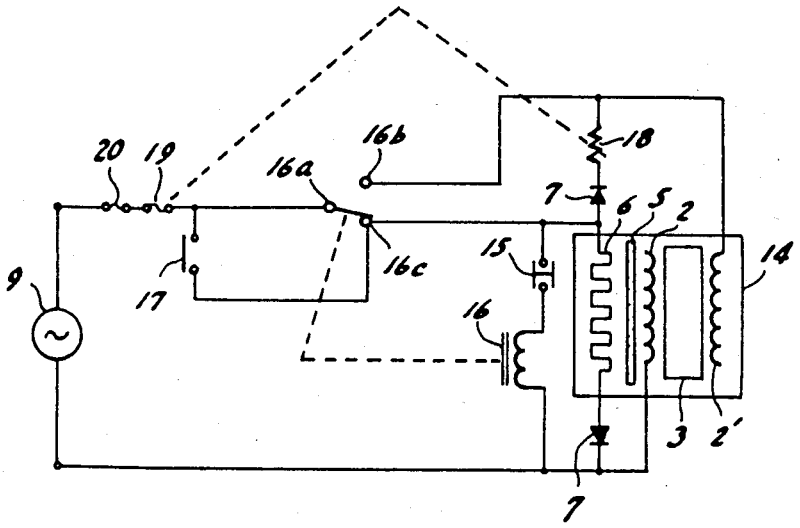
FIG. 12 is a circuit diagram of a heater including the flexible heating wire of FIG. 11.

Operation of the flexible heating wire of FIG. 11 will be described. In FIG. 12, the flexible heating wire is generally denoted at 14 and includes the first conductive wire 6 serving as the heating body, the thermally fusible electrically insulative body 5, the second and third conductive wires 2', 2 serving as electrodes, and the PTC heating body 3. The flexible heating wire is incorporated in a heater comprising a series-connected circuit composed of a thermostat 15 and a relay 16 and having one end connected to the third conductive wire 2 and an AC power supply 9. The relay 16 has relay contacts **16*b*, 16*c* and a movable contact 16*a*. The series-connected circuit has an opposite end connected to the relay contact 16*c*. A reset switch 17 is connected between the relay contact 16*c* and the movable contact 16*a*. The relay contact 16*b* is connected to the second conductive wire 2'. When the coil of the relay 16 is energized, the movable contact 16*a* is connected to the relay contact 16*c*, and when the relay coil is de-energized, the movable contact 16*a* is connected to the relay contact 16*b*. The thermostat 15 is positioned in thermally coupled relation to the flexible heating wire 14. The first conductive wire 6 is connected at one end to the relay contact 16*b* through a diode 7 and a resistor 18 and at an opposite end to the AC power supply 9 through another diode 7**.

When a power supply switch is turned on to close the reset switch 17 which is ganged with the power supply switch, the relay 16 is energized since the thermostat 15 has been turned on, thereby bringing the movable contact **16*a* into contact with the relay contact 16*c* to pass an electric current through the first conductive wire 6 serving as the heating body. As the first conductive wire 6 is heated, the flexible heating wire is heated up to a turn-off temperature of the thermostat 15, whereupon the thermostat 15 is opened to de-energize the relay 16. The second conductive wire 2' is now automatically connected to the power supply to heat the PTC heating body 3. Therefore, the first conductive wire 6 having no PTC characteristics is heated after the flexible heating wire has started being energized until it reaches the turn-off temperature of the thermostat 15, and thereafter the PTC heating body 3** is heated.

Figure 13:
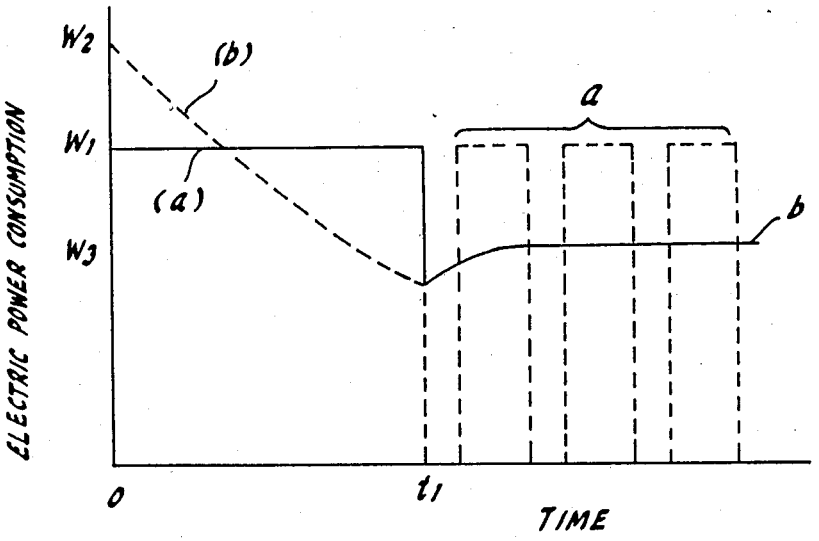
FIG. 13 is a graph showing the relationship between the amount of electric power consumed by the heater of FIG. 12.
Figure 14:
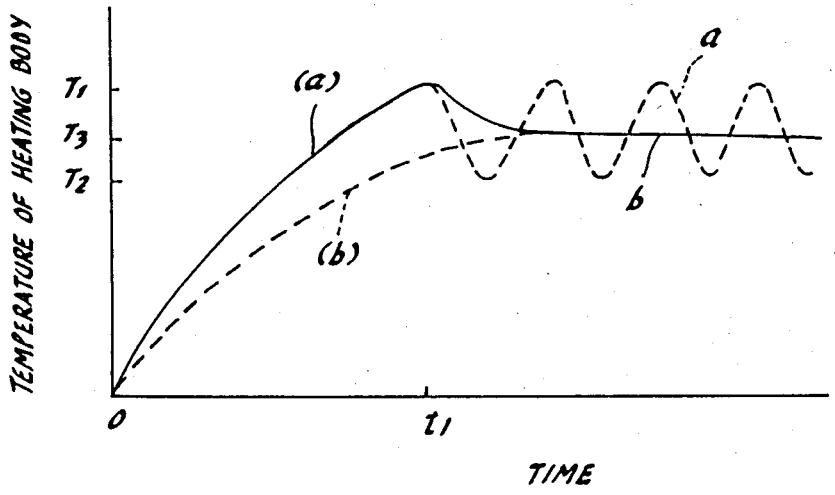
FIG. 14 is a graph showing the relationship between the temperature of a heating section of the heater and the time in which an electric current is supplied.

FIG. 13 illustrates the amount of electric power consumption as it varies with time. The flexible heating body of the invention concumes electric power at a constant level as indicated by the solid line (a) during an interval of time between 0 and $t_1$, and then consumes electric power as indicated by the solid line b after $t_1$, $t_1$ being the time when the thermostat 15 is de-energized. The rectangular wave indicated by the broken lines a after $t_1$ represents a pattern of electric power consumption by a conventional heating wire which is turned on and off alternately, and the curve indicated by the broken line (b) between 0 and $t_1$ represents a power consumption pattern of the conventional heating wire which is heated from the beginning. It is to be noted that the conventional heating wire consumes a larger amount of electric power $W_2$ when it starts to be energized than electric power consumed during a stable period after $t_1$, thus requiring an increased rush current. FIG. 14 shows the temperature of the heating section as it varies with time. According to the present invention, the temperature increases along the curve indicated by the solid line (a) until the time $t_1$ when the thermostat 15 is turned off, and then gradually falls along the curve indicated by the solid line b. The temperature of the prior heating wire as it is turned on and off alternately after $t_1$ alternately rises and falls along the curve indicated by the broken line. The curve indicated by the broken line (b) represents a temperature rise according to a conventional heating body. As shown in FIG. 14, the temperature rises at a fast rate if the heating wire is first heated up to a temperature $T_1$ higher than a temperature $T_3$ for the stable heating period, a feature which is preferable for practical use.

With the flexible heating wire 14 shown in FIG. 12, the two heating bodies 3, 6 are combined in a manner to be thermally coupled with each other throughout the entire heating section of the flexible heating wire, with the result that switching between the two heating bodies 3, 6 can smoothly be carried out.

When the PTC heating body 3 suffers from an undue temperature rise, the thermally fusible electrically insulative body 5 is melted away to allow the third conductive wire 2 and the first conductive wire 6 as the heating body to be brought into electric contact with each other, whereupon the resistor 18 (FIG. 12) is heated to melt a temperature fuse 19 that is thermally coupled with the resistor 18 to cut off the current from the power supply. When the second and third conductive wires 2', 2 are short-circuited, or only the first and third conductive wires 6, 2' are brought into contact to allow an increased current to flow into the first conductive wire 6 from the point of contact, a current fuse 20 is melted away to cut off the current so that desired safety can be assured.

Flexible heating wires having a plurality of PTC heating bodies of different PTC characteristics according to sixth and seventh embodiments will be described with reference to FIGS. 15 and 16, respectively.

Figure 15:
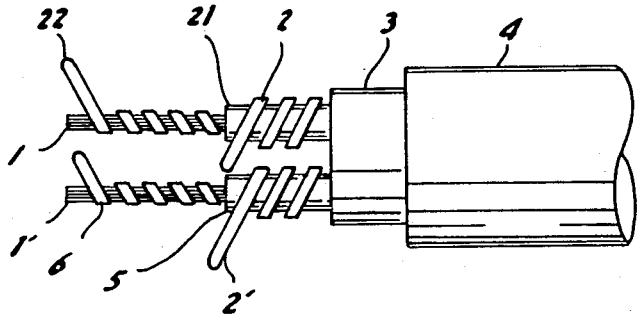
FIGS. 15 and 16 are front elevational and perspective views, respectively, of flexible heating wires according to sixth and seventh embodiments of the present invention.

The flexible heating wire shown in FIG. 15 comprises a second PTC heating body 21 and a fourth conductive wire 22 added to the heating wire construction as illustrated in FIG. 3.

Figure 16:
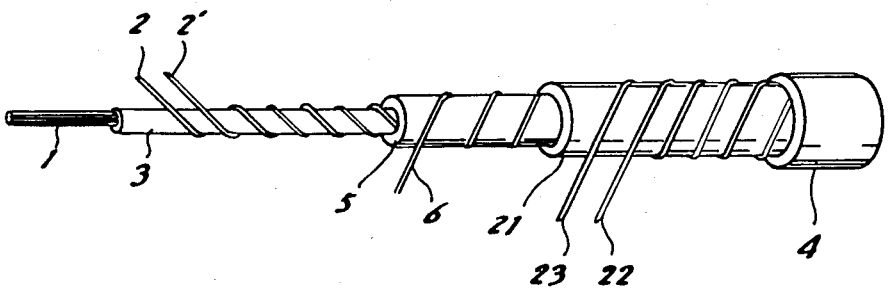

The flexible heating wire shown in FIG. 16 comprises a second PTC heating body 21 and fourth and fifth conductive wires 22, 23 added to the heating wire construction as illustrated in FIG. 5.

Figure 17:
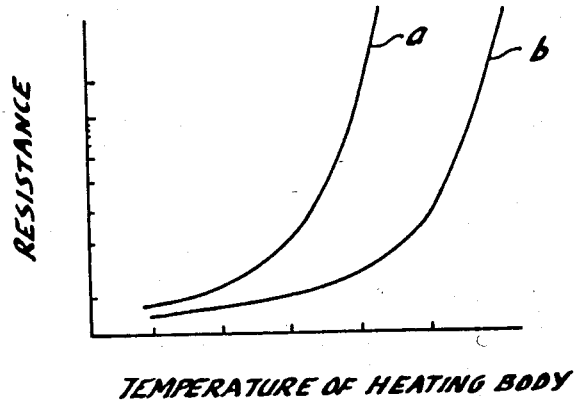
FIG. 17 is a graph showing positive-temperature-coefficient curves of heating bodies in the flexible heating wires illustrated in FIGS. 15 and 16.

The PTC heating bodies 3, 21 in FIGS. 15, 16 have different PTC characteristic curves a, b, for example, in FIG. 17. By incorporating the two PTC heating bodies 3, 21 into a single composite heating wire, two saturation temperatures of the heating bodies can easily be selected without altering the heating section of the heating wire. Where the heating wire is assembled in a heater, the heater can be used in different temperature modes of operation.

The resistances of the PTC heating bodies 3, 21 are mainly determined by their specific resistances. However, their resistances can be adjusted by the distance between the electrodes and the distance between the PTC heating bodes 3, 21. Where a circuit arrangement of FIG. 18 with the PTC heating bodies 3, 21 of FIG. 15 incorporated therein is employed, two temperatures available for use can easily be achieved. Likewise, two different temperatures can be obtained by electrically connecting the conductive wires 2, 23 in the flexible heating wire illustrated in FIG. 16.

Figure 18:
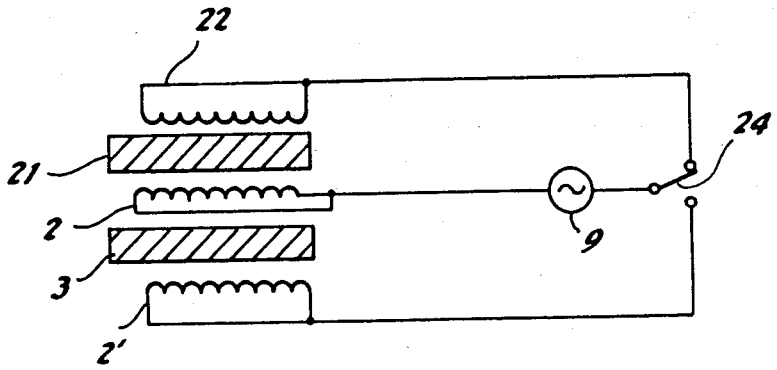
FIG. 18 is a circuit diagram of a PTC heating section of a heater using the flexible heating body of FIGS. 15 and 16.

In FIG. 18, winding starting and terminating ends of the conductive wires 2', 2, 22 are connected. This is to reduce to half voltage drops produced by passing currents through the conductive wires 2', 2, 22 due to their resistances, and to permit the conductive wires 2', 2, 22 to be heated even when they are cut off at a single location. Assuming that the first PTC heating body 3 has a PTC characteristic curve a as shown in FIG. 17 and the second PTC heating body 21 has a PTC characteristic curve b, the temperature can be set to a low level when the movable contact of a changeover switch 24 (FIG. 18) is connected to the conductive wire 2', and the temperature can be set to a hig level when the movable contact of the changeover switch 24 is connected to the conductive wire 22. Furthermore, one of the PTC heating bodies 3, 21 may be utilized as a temperature sensor. Since one of the PTC heating bodies 3, 21 remains de-energized at any time, and is completely thermally coupled with the other heating body, any change in the resistance of the one PTC heating body can be used as a signal indicative of a temperature change. Combined with a control cirucit, such a signal allows complicated temperature adjustment of the flexible heating wire. With the embodiments of FIGS. 15 and 16, the temperature can be adjusted through a simple arrangement. Although the number of electrodes used is increased with a resulting greater tendency toward undue overheating, a sufficient degree of safety can be ensured in the embodiments of FIGS. 15 and 16 by the thermal fusibility of the thermally fusible electrically insulative body 5.

The present invention offers the following various advantages:

(1) When the distances between the conductive wires are locally reduced due to external oppression, bending, or twisting, or when a conductive material has been mixed in the PTC heating body, or when the electrode wires are cut off or about to be cut off, or when the flexible heating wire is unduly heated by an external source, any localized overheating, abnormal heating, overheating due to the generation of an arc can be prevented for increased safety.

(2) With the PTC heating body and the thermally fusible electrically insulative body being compatible with each other, desired safety of the PTC heating body after use over a prolonged period is ensured.

(3) Since the conductive wires used as electrodes are retained by and between opposite surfaces of the PTC heating body and the thermally fusible electrically insulative body, the distance between the conductive wires remains substantially unchanged when they are subjected to oppression, bending, or twisting, resulting in improved uniformity of the temperature of the heating wire.

(4) By combining the core and the electrically conductive wires, the flexible heating wire can be smaller in diameter, and strong in tensile strength and bending strength.

(5) Use of two different PTC heating bodies allows greater leeway in use, i.e., selective availability of different temperatures.

(6) An excessive current can be prevented from flowing at the time the flexible heating wire starts being energized by using one of the conductive wires as a heating body.

(7) The rate at which the temperature of the heating body rises can be increased by using one of the conductive wires as a heating body.

(8) By incoporating a plurality of PTC heating bodies having different PTC characteristics into one heating wire, the range of available temperatures can be widened without having to altering the heating cootion of the heating wire.

(9) One of the PTC heating bodies incorporated in a single heating wire may be employed as a temperature sensor for more complicated temperature control of the heating wire.

Although certain preferred embodiments of the present invention have been shown and described in detail, it should be understood that various changes and modifications may be made therein without departing from the scope of the appended claims.

What is claimed is:

1. A flexible heating wire comprising a tubular heating body having a positive temperature coefficient and having inner and outer surfaces, second and third conductive bodies wound on said inner or outer surface of said tubular heating body in spaced relation to each other, a thermally fusible electrically insulative body disposed on said inner or outer surface of said tubular heating body in contact with said second and third conductive bodies and said heating body, and a first conductive body disposed on said thermally fusible electrically insulative body remotely from said second and third conductive bodies, said second and third conductive bodies being electrically contactable with each other to electrically disconnect the heating wire in the event that the thermally fusible electrically insulative body is thermally fused.

2. A flexible heating wire according to claim 1, including a core covered with said heating body, said second and third conductive bodies being disposed on said heating body, said thermally fusible electrically insulative body being disposed on said second and third conductive bodies, said first conductive body being disposed on said thermally fusible electrically insulative body.

3. A flexible heating wire according to claim 1, wherein said second and third conductive bodies are wound around said heating body, said first conductive body being wound around said thermally fusible electrically insulative body.

4. A flexible heating wire according to claim 1, wherein said heating body is made of a polyolefin polymer containing carbon therein.

5. A flexible heating wire according to claim 1, wherein said thermally fusible electrically insulative body is made of polyamide resin.

6. A flexible heating wire according to claim 1, wherein at least one of said first, second and third conductive bodies comprises a heating wire.

7. A flexible heating wire according to claim 1, wherein said thermally fusible electrically insulative body is tubular in shape.

* * * * *